US007703594B2

(12) United States Patent
Stein

(10) Patent No.: US 7,703,594 B2
(45) Date of Patent: Apr. 27, 2010

(54) ESCALATOR OR MOVING SIDEWALK

(75) Inventor: Wolfgang Stein, Neumünster (DE)

(73) Assignee: ThyssenKrupp Fahrtreppen GmbH (DE)

( * ) Notice: Subject to any disclaimer, the term of this patent is extended or adjusted under 35 U.S.C. 154(b) by 191 days.

(21) Appl. No.: 10/593,168

(22) PCT Filed: Mar. 17, 2005

(86) PCT No.: PCT/EP2005/002853

§ 371 (c)(1),
(2), (4) Date: Jul. 8, 2008

(87) PCT Pub. No.: WO2005/090220

PCT Pub. Date: Sep. 29, 2005

(65) Prior Publication Data

US 2008/0257682 A1 Oct. 23, 2008

(30) Foreign Application Priority Data

Mar. 17, 2004 (DE) ..... 20 2004 004 178 U

(51) Int. Cl.
*B66B 31/00* (2006.01)

(52) U.S. Cl. ..... 198/321; 198/326

(58) Field of Classification Search ..... 198/321, 198/860.1, 326

See application file for complete search history.

(56) References Cited

U.S. PATENT DOCUMENTS

| | | | | |
|---|---|---|---|---|
| 2,936,872 | A * | 5/1960 | Kneipp | 198/326 |
| 4,811,829 | A | 3/1989 | Nakazawa | |
| 6,374,981 | B1 * | 4/2002 | Gschwendtner et al. | 198/321 |
| 6,814,215 | B2 * | 11/2004 | Krampl | 198/321 |
| 2002/0175039 | A1 | 11/2002 | Fargo et al. | |
| 2003/0116402 | A1 | 6/2003 | Krampl | |

FOREIGN PATENT DOCUMENTS

| | | |
|---|---|---|
| DE | 2010662 | 9/1971 |
| DE | 2519310 | 11/1975 |
| DE | 9134167 | 11/1981 |
| DE | 4117901 | 10/1992 |
| DE | 10146205 | 4/2003 |
| EP | 1273548 | 1/2003 |
| JP | 2004018152 | 1/2004 |

* cited by examiner

*Primary Examiner*—James R Bidwell
(74) *Attorney, Agent, or Firm*—Robert W. Becker & Assoc.; Robert W. Becker

(57) ABSTRACT

An escalator or moving sidewalk exhibits a frame for the formation of a supporting structure between entry and exit that is made at least partially of perforated plate, with the holes in particular being provided over a significant part of the frame height, preferably roughly one half the frame height.

19 Claims, 5 Drawing Sheets

ESCALATOR OR MOVING SIDEWALK

This specification for the instant application should be granted the priority date of Mar. 17, 2004, the filing date of the corresponding German patent application 20 2004 004 178.2 as well as the priority date of 17 Mar. 2005, the filing date of the corresponding International patent application PCT/EP2005/002853.

BACKGROUND OF THE INVENTION

The invention relates to an escalator or moving sidewalk.

It has been known for a long time that escalators and moving sidewalks must exhibit frames to ensure support for the step or pallet band between entry and exit.

Corresponding chain rollers and step rollers typically each run on separate rails supported by a frame made of sections. In order to form the required step pattern or to provide the desired pallet band, the rails have to run at a given height and be supported safely and in particular also rigidly there. If the rail were to bend too much, not only would the passenger be given a feeling of insecurity, there would also be a risk that in the event of an asymmetric load of the step or pallet band, the specified clearance would be exceeded so that the step or pallet would scrape on the rail.

It is therefore important that the frames used are particularly rigid and do not bend beyond the given tolerances even in the event of the maximum permissible operating load of the escalator, but also for example of a self-supporting moving sidewalk.

In order to achieve the desired rigidity, combinations of T and U sections welded together are typically used that together form an essentially U-shaped channel that is given additional rigidity by transverse struts. This design has proven to be effective even with long unsupported lengths, for example of even 20 m or 30 m.

On the other hand, the use of such solid steel constructions is expensive and labor-intensive, and also demands heavy-duty supports at the entry and exit. This is unfavorable, as it increases the cost of the building in which the escalator or moving sidewalk is to be installed. If, for example, an escalator extends between different floors in a department store, the escalator shaft is not typically located next to pillars. The high support weight means, however, that considerable forces have to be bome, so that possibly the thickness of the concrete ceilings or at least the reinforcement has to be increased.

It is naturally also possible to install supporting columns that extend from bottom to top through the escalator shaft. Such pillars are undesirable, however, for esthetic reasons.

It has furthermore been known for around 15 years that a wire rope can be used as a bearer for an escalator frame. Such a solution was installed, for example, by CNIM, 35 rue de Bassano, Paris, in Paris-Bercy Charenton in the early 1990s. This solution is somewhat unsatisfactory from an esthetic point of view, however, as the exposed steel rope gives a very technical impression, even though it contributes to minimizing the weight of the frame.

A further problem is the high cost for creation of the supporting structure. The frames are typically prefabricated in sections of, for example, 2 m or 3 m in length by welding together the sections at the factory. On site they are then lifted to the desired position with cranes or lifting platforms or similar equipment and welded together there. This solution is extremely time and labor-intensive, requires heavy equipment and is a major contribution to the costs for the construction of the escalator.

The object of the invention is therefore to create an escalator or moving sidewalk that is lighter in weight without losing rigidity so that it can also be used for buildings with a low load-bearing strength while at the same time reducing the manufacturing costs.

SUMMARY OF THE INVENTION

This object is realized in accordance with an escalator or moving sidewalk comprising a frame to form a supporting structure between an entry and an exit, wherein the frame is composed at least partially of a perforated plate structure having round holes or hole cut-outs in particular on the side surfaces of the frame, and wherein the holes or hole cut-outs are provided over a significant portion of the height of the frame, preferably over approximately over half of the height of the frame.

The solution according to the invention provides for the use of perforated plates that form the frame as a perforated plate frame. Even though the term "perforated plate" is used here, it goes without saying that this does not mean a prior art perforated plate, but a specially manufactured plate in which large holes are made arranged alternately and in various sizes, whereby the largest holes can, for example, quite easily have half the height of a side plate, in other words can have a diameter of, for example, 50 cm.

Surprisingly such perforated plates have the advantage that even on exposure to constant vibrational stress such as occurs with an escalator, the material fatigue is particularly low and that despite the fact that a comparatively low weight with high strength can be inexpensively produced. The propagation of vibrations is apparently suppressed by the irregularly arranged holes so that the feared resonances are avoided.

A perforated plate with large holes according to the invention can be manufactured by any suitable means.

The perforated plates according to the invention can be produced by cutting, for example laser cutting, but also using any other plate cutting techniques. The perforated plate structure according to the invention permits a significantly reduced weight to be achieved compared with the manufacture using welded U and T sections; surprisingly, with the same bending of an escalator of 20 m length, the weight of the frame is reduced to roughly one half.

Surprisingly, the prefabricated long sections of side plates and base plates can be manufactured far less expensively using the solution according to the invention. The significantly reduced wall thicknesses allow the frame to be handled better on site, and the necessary load-bearing strength of the floor ceilings is greatly reduced in view of the considerably reduced weight. The heavy equipment used for installation can also be reduced, with the use of cranes possibly becoming even dispensable.

Nevertheless the solution according to the invention provides an exceptionally rigid supporting construction for the frame. The weld seams of base plate and side plates provided for on site are preferably not made at the same point in the longitudinal direction, but are offset from one another, thus additionally enhancing the rigidity.

In an advantageous embodiment, provision is also made for the welding on of small plate ribs. When using a laser cutter and laser welder, such constructions can be produced inexpensively, automatically and quickly away from the factory, so that the manufacturing time is significantly reduced. This means on the other hand that an escalator manufacturer can work with lower stocks of prefabricated sections and corresponding elements, further reducing production costs.

Surprisingly, the removal of material of the holes cut out of the plates to produce the large-hole perforated plate according to the invention does not essentially result in a weakening of the plate used, and on the other hand a significant reduction in weight of, for example, 40% can be achieved, depending on the arrangement of the cut holes. While circular holes are preferred, ft goes without saying that elliptical holes can in some circumstances also have benefits.

The circular cut-outs from the plate represent high-quality and recyclable sheet steel so that the solution according to the invention does not result in any cost disadvantages for the waste disposal either.

The use of sheet steel for escalators and moving sidewalks has admittedly been known for a long time, for example for the balustrade side cover plates, but also for other cover plates and in some cases also for step guides.

Such essentially known solutions do not, however, offer any genuine supporting function for the escalator or moving sidewalk, and certainly not the large-hole plate structure necessary according to the invention.

It goes without saying that the exact design of the plates according to the invention can be extensively adapted to meet the requirements. For structural reasons it is favorable if the circular holes are offset from one another so that the transitions between the holes run practically at an angle into one another.

For example, a certain hole pattern can be specified that is then repeated. For example, the prefabricated plate sections can have a length of one meter and a grid arrangement of 4 units.

An alternative modified embodiment of the escalator according to the invention provides for the plates cut to length in the grid dimensions to overlap so that the adaptation area provided for once with each escalator or moving sidewalk involves certain weight disadvantages over a length of less than 1 meter, but that no loss of rigidity is to be expected at these critical points.

The upper run and lower run of the step or pallet band typically run with a significant distance between them. At the entry and exit, the distance is determined by the diameter of the drive wheel or deflection wheel of the step or pallet chain.

The space remaining between the runs allows additional transverse struts to be installed as with the prior art and hence to add further rigidity to the plate construction according to the invention. Such transverse struts can consist of folded plate, but can also be constructed as profiled sections.

An advantageous embodiment provides for the return drums adjacent to the entry and exit to also be manufactured from large-hole perforated plate. By limiting the longitudinal section in this area, for example, to a length of 3 m or 4 m, a corresponding plate can be prefabricated with a width of, for example 1.50 m as a basis rather like the base plate, while the side plates extending over the length of the escalator or moving sidewalk can be made from plates with a width of approx 1 m.

Corresponding protruding areas of such side plates then allow supports for the head plates to be provided for the entry and exit.

According to the invention it is intended that flat plates should be cut by laser. If necessary, the plates can also be edged at the ends, for example by rolling. It goes without saying that in order to achieve the desired strength, the dimensioning of the plates is adapted to the requirements.

According to the invention it is particularly favorable if the desired large-hole plate structure is obtained with flat plates by laser cutting and the connection to plates running transversely to these is made by laser welding. It goes without saying, however, that, particularly when working on site, any other welding techniques can also be employed.

According to the invention it is intended that the side plates are placed on the base plate and welded there, preferably with a continuous weld seam, during prefabrication at the factory. It goes without saying that any other suitable method of joining can also be employed, possibly also riveting after corresponding edging of one of the plates.

BRIEF DESCRIPTION OF THE DRAWINGS

Further advantages, details and features can be taken from the following description of an exemplary embodiment using the drawing, in which.

DESCRIPTION OF SPECIFIC EMBODIMENTS

Figure 1:
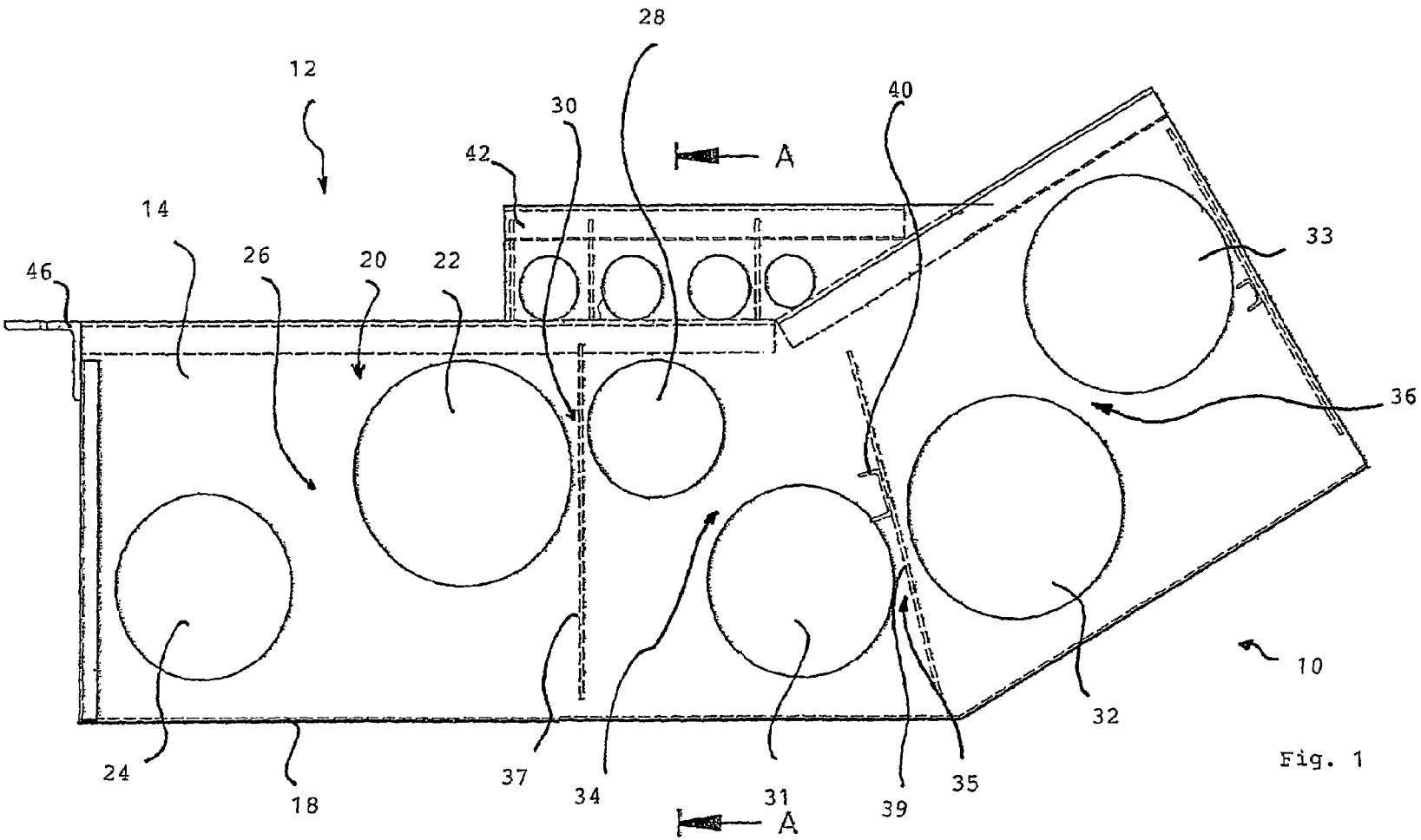
FIG. 1 shows a side view of one part of an embodiment of an escalator according to the invention, namely a side plate.

The escalator 10 shown partly in FIG. 1 in the embodiment according to the invention exhibits a perforated plate frame 12 that has an essentially U shape. FIG. 1 shows a side view of the U, in other words a view of one of the side legs.

Figure 3:
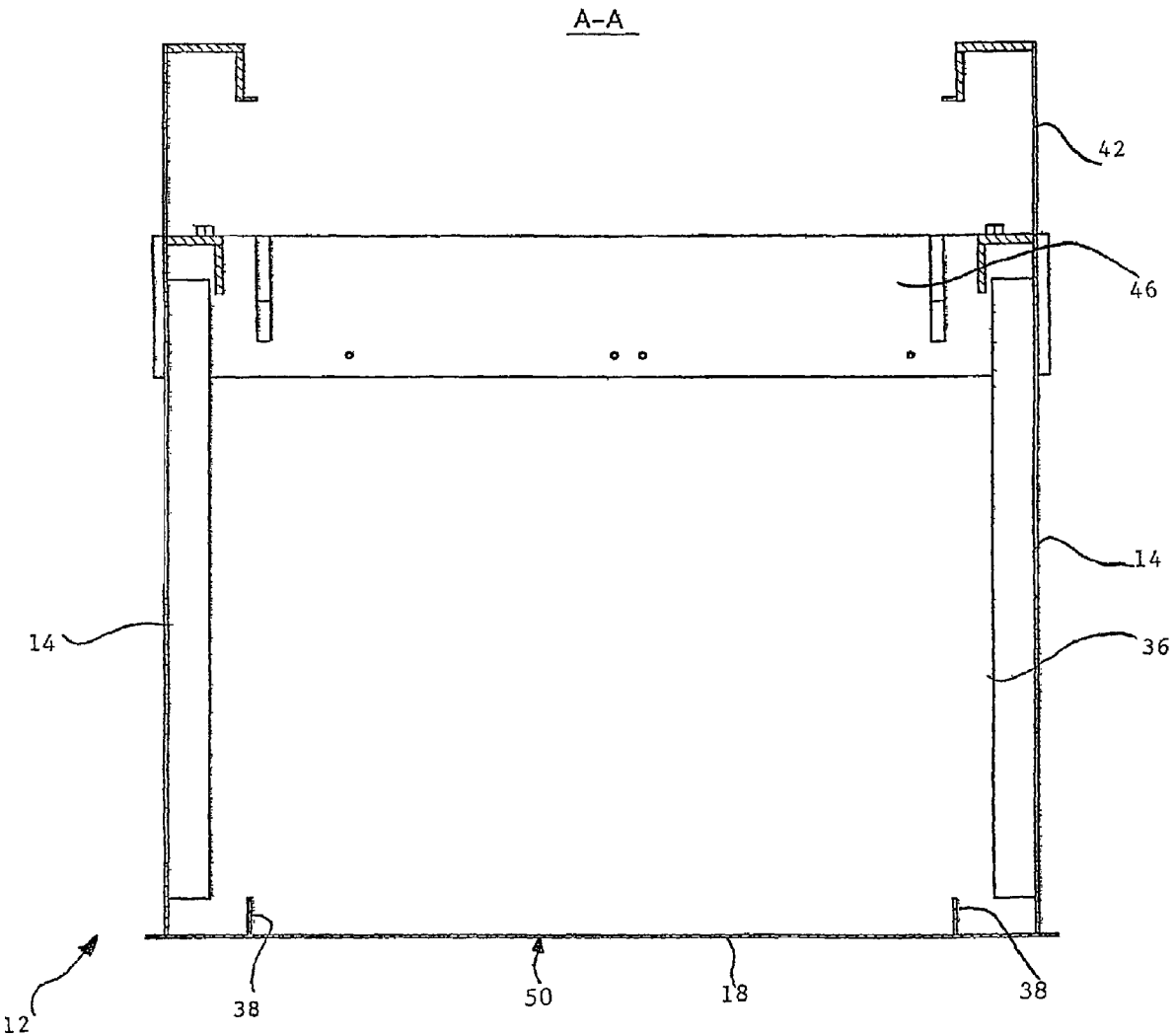
FIG. 3 shows a section through the escalator according to the invention in the embodiment according to FIG. 1, along the line A-A.

The side legs are formed by side plates, one side plate 14 of which can be seen in FIG. 1, while the middle leg is formed in each case by a base plate as can be seen in the form of the base plate 18 in FIG. 3.

The side plate 14 shown in FIG. 1 exists here in the form of a side plate cut-out that is intended for the form entry or exit of the escalator.

Figure 2:
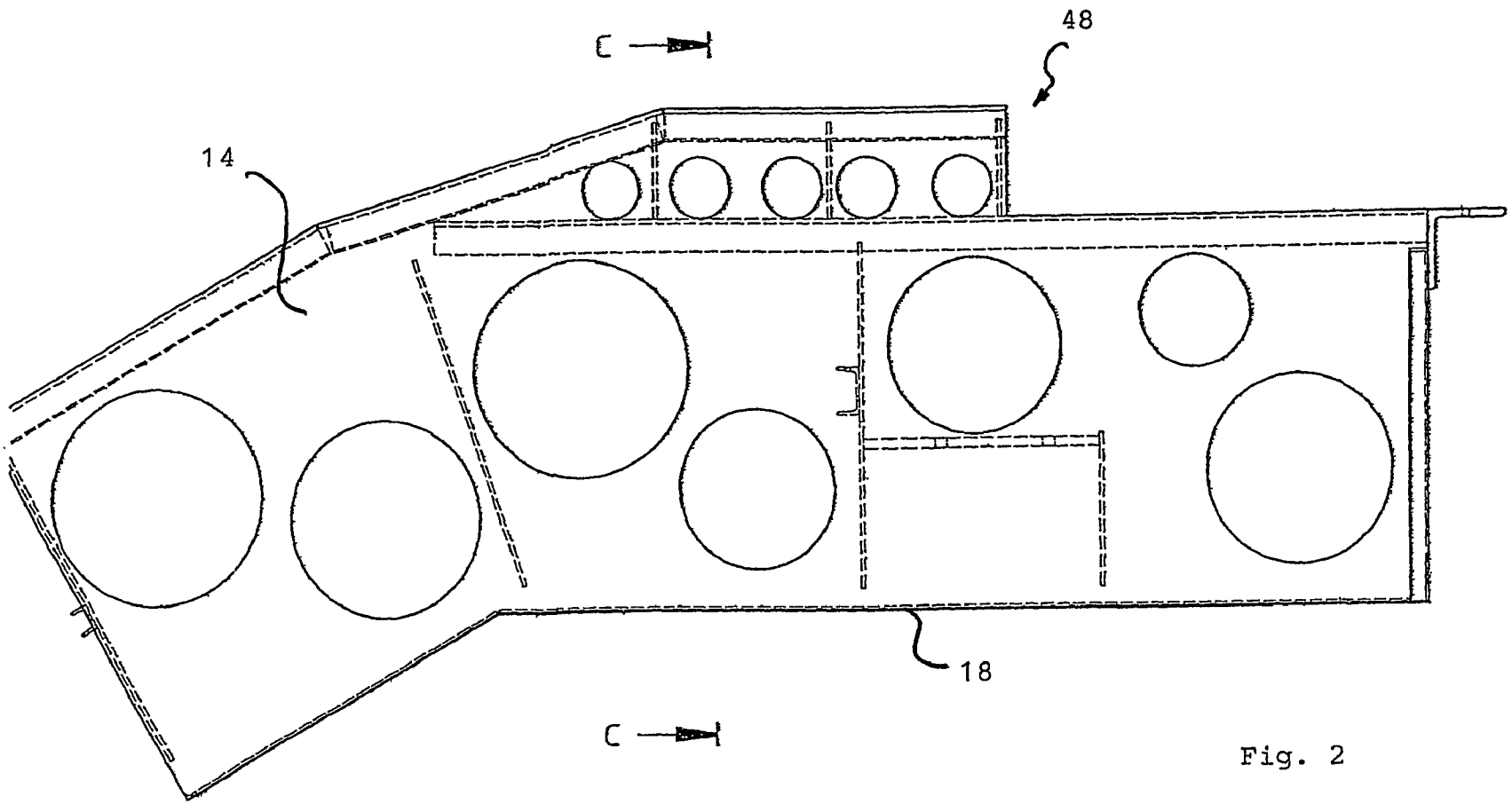
FIG. 2 shows a side view of one part of the embodiment according to FIG. 1, namely another side plate.

The part of the side plate 14 pointing upwards at an angle is essentially connected to further side plates so that the combination of the end side plates shown in FIGS. 1 and 2 and the middle side plates extending between these form the complete side plates of the escalator.

It goes without saying that in the case of a moving sidewalk, the side plates used for the entry and exit are also straight and not cropped as shown in FIG. 1.

In accordance with the invention, the side plate 14 exhibits a large-hole plate structure 20. In the exemplary embodiment shown, a hole cut-out 22 extends over a height of just about 60% of the side plate 14 and closer to the upper edge of the side plate 14.

At a distance from the hole cut-out 22 and offset from it extends a slightly smaller hole cut-out 24 closer to the lower end of the side plate 14. Between the hole cut-outs 22 and 24 are hole transitions 26 whose width, size, position and inclination can be extensively adapted to the requirements. The orientation of adjacent hole transitions differently from one another is preferred.

In the exemplary embodiment shown, the hole cut-outs 22 and 24 are not, however, arranged alternately at the top and bottom of the side plate. The hole cut-out 22 is in fact adjacent to a quite small hole cut-out 28 that is also arranged at the upper end, while a quite narrow hole transition 30 extends between the hole cutout 22 and the hole cut-out 28. In the manner shown in FIG. 1, further hole cut-outs 31, 32 and 33 extend in different distributions, while hole transitions 34, 35 and 36 are located between adjacent hole cut-outs.

Adjacent hole cut-outs or holes are at least either not at the same height or do not have the same diameter. Thanks to this arrangement by way of a stochastically distributed arrangement it is possible to obtain a low-resonance structure of the large-hole plate 20 according to the invention.

The perforated plates are produced by cutting corresponding round holes 32 out of the initially complete plate. Cutting out can be performed in any suitable manner, but preferably by laser cutting. The holes are preferably round so that the introduced force is homogenized without stress concentrations.

The perforated plate structure 20 shown in FIG. 1 is given additional rigidity by further ribs. Examples here are the ribs 37 and 39. The ribs 37 run through the hole transition 30 perpendicularly to the main orientation of the side plate 14 almost to the base plate 18. By contrast, the ribs 39 run through the hole transition 35 and extend essentially also over the whole height of the side plate 14. The ribs each extend inward, for example over a width of 5 cm. They are formed by plate strips welded on there.

The same applies to the ribs 38 that run along the base plate 18, as shown in FIG. 3.

Figure 4:
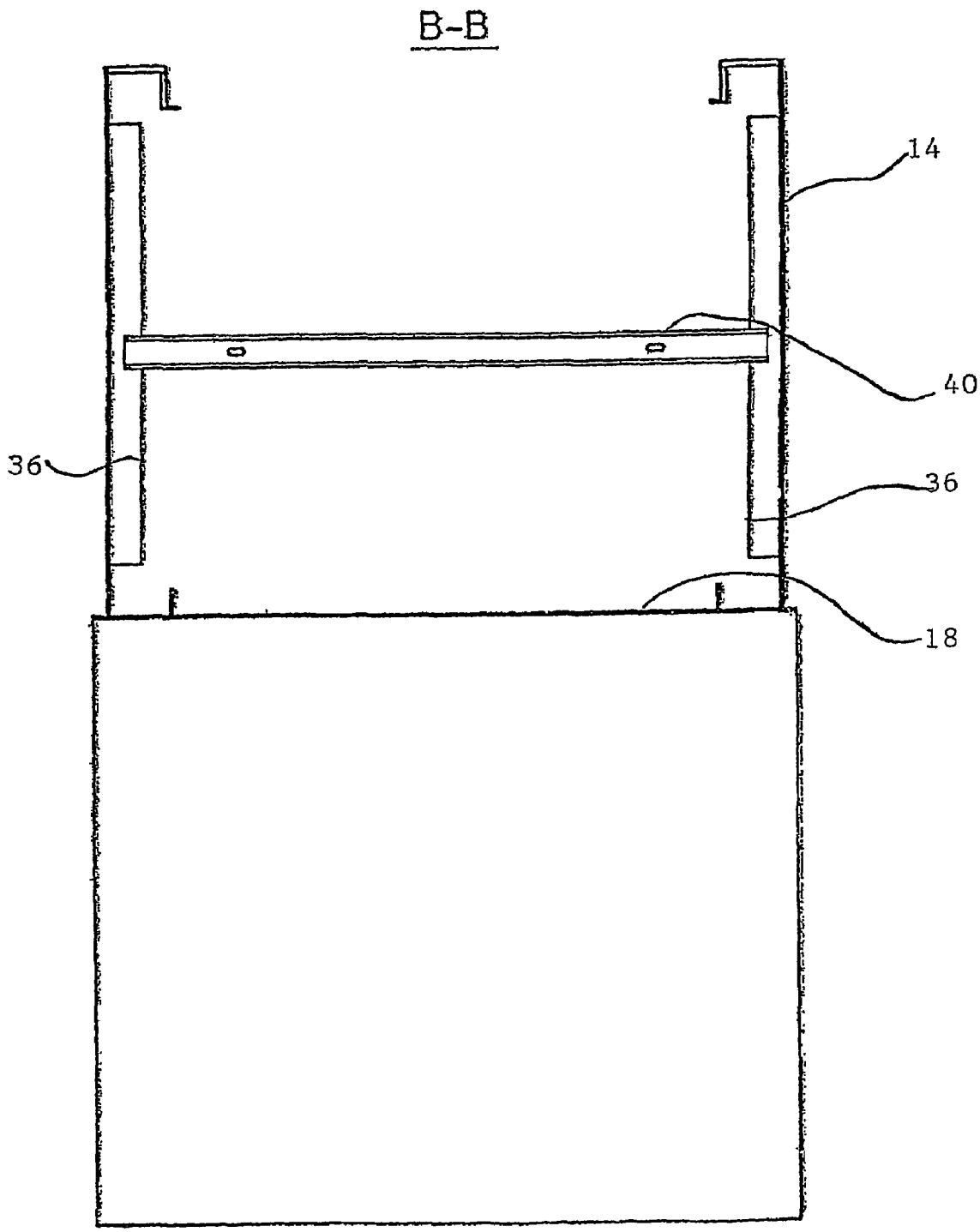
FIG. 4 shows a section through the escalator according to the invention in the embodiment according to FIG. 1, along the line B-B.

In addition, transverse struts 40 are provided roughly in the middle of the hole transitions 35 and extend between the two side legs of the U. Such transverse struts can be seen, for example, in FIGS. 4 and 5.

A protruding section 42 is provided at the top of the side plates 14 in a manner as illustrated in FIG. 1 and FIG. 3. The head plate of the escalator according to the invention can be supported at this point.

At the end, the frame according to the invention is terminated by an L section 46 that extends between the two side walls 14.

FIG. 2 shows a corresponding construction of a side plate portion for the upper entry or exit.

The same reference numbers here indicate the same parts, as in the other figures.

Figure 5:
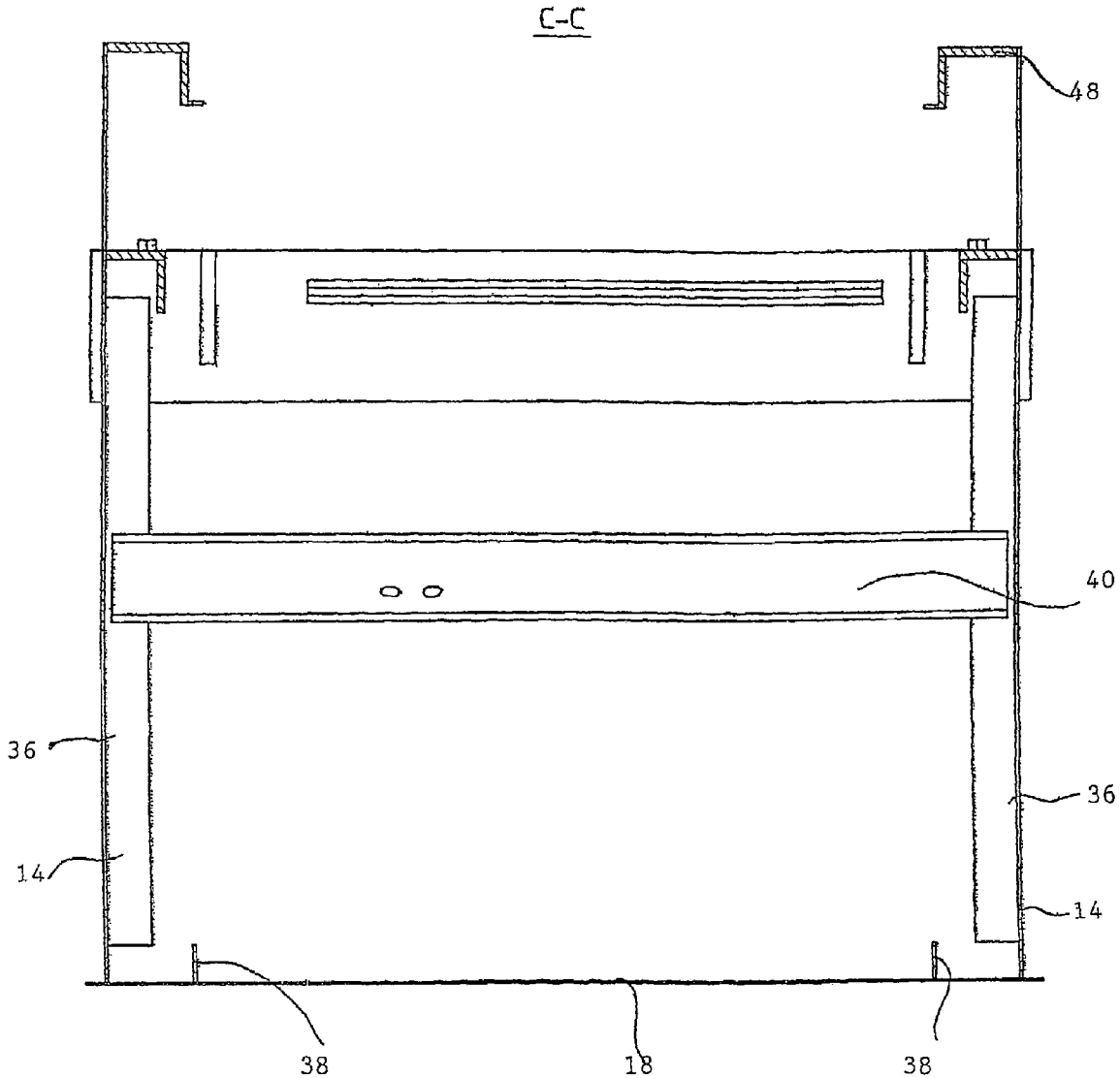
FIG. 5 shows a section through the escalator according to the invention in the embodiment according to FIG. 2, along the line C-C.

It can be seen that a protruding section 48 is also provided that extends beyond the upper rib 22 and whose design can be seen from FIG. 5.

The side plates 14 according to the invention are linked by a base plate 18. The base plate 18 also preferably exhibits hole cut-outs 50 not illustrated here. It is preferred that in the area of the ribs 38, and hence quite far to the side, no cut-outs are provided in order to guarantee full-surface support for the welded-on ribs 38.

The frame according to the invention of the escalator in accordance with the invention is exceptionally rigid both as a section and when welded together and exhibits a particular low weight in relationship hereto. It goes without saying that the width and arrangement of the hole cut-outs can be extensively adapted to the requirements. Furthermore, production is not limited to laser cutting and laser welding; any other form of material separation and material joining can be employed. The plate thickness can also be extensively varied, depending on the demand profile, in order to provide the desired strength.

The specification incorporates by reference the disclosure of German priority document 20 2004 004 178.2 filed Mar. 17, 2004 and PCT/EP2005/002853 filed Mar. 17, 2005.

The present invention is, of course, in no way restricted to the specific disclosure of the specification and drawings, but also encompasses any modifications within the scope of the appended claims.

The invention claimed is:

1. An escalator or moving sidewalk, comprising:

a frame to form a supporting structure between an entry and an exit, wherein said frame is composed at least partially of a perforated plate structure having round holes or hole cut-outs at least on side surfaces of said frame, wherein said holes or hole cut-outs are provided over a significant portion of a height of said frame, further wherein said perforated plate frame is provided with two side plates and a base plate that are fixedly connected or welded together to form an essentially U-shaped structure, and wherein said holes in said two side plates are disposed such that adjacent holes are offset from one another.

2. An escalator or moving sidewalk according to claim 1, wherein said holes or hole cutouts are provided over approximately half of the height of said frame.

3. An escalator or moving sidewalk according to claim 1, wherein edges of said holes or hole cut-outs are free of straight sections.

4. An escalator or moving sidewalk according to claim 1, wherein said holes or hole cut-outs have a round, oval and/or ellipsoid form.

5. An escalator or moving sidewalk according to claim 1, wherein said side plates are welded to said base plate, in particular by laser welding.

6. An escalator or moving sidewalk according to claim 1, wherein end side plates and an end base plate are respectively formed at said entry and at said exit, and wherein said end side plates and said base plate are cropped in conformity with an inclination of said escalator.

7. An escalator or moving sidewalk according to claim 6, wherein middle side plates and middle base plates extend between said end side plates and said end base plate and are prefabricated in a given length of, for example, 4 or more meters.

8. An escalator or moving sidewalk according to claim 1, wherein said perforated plate frame has a hole pattern characterized by a ratio between plate and air of less than 3:1, in particular somewhat less than 2:1.

9. An escalator or moving sidewalk according to claim 1, wherein inwardly facing profiled sections are attached to said side plates, in particular by welding, and serve for receiving travel rails for rollers of escalator steps or moving sidewalk pellets.

10. An escalator or moving sidewalk according to claim 1, wherein welded-on ribs are provided to reinforce those of said side plates that extend perpendicular to a step or pallet band of said escalator or moving sidewalk.

11. An escalator or moving sidewalk according to claim 10, wherein said welded-on ribs also extend between said holes.

12. An escalator or moving sidewalk according to claim 1, wherein larger ones of said holes extend over approximately 60% of a height of said side plates, wherein smaller ones of said holes extend over approximately 20% of the height of said side plates, and wherein small holes and large holes are disposed alternatingly.

13. An escalator or moving sidewalk according to claim 1, wherein said side plates and said base plate are assembled with longitudinal welds from plates of different thickness and/or strength, as a function of desired load-bearing strength.

14. An escalator or moving sidewalk according to claim 1, wherein said supporting structure is provided with a transverse frame having a predetermined width and into which said base plate can be placed or to which said base plate can be secured, or wherein said supporting structure is provided with mountings for further structural components for which in particular an exact relative position between right hand and left hand sides is fixed.

15. An escalator or moving sidewalk, comprising:

a frame to form a supporting structure between an entry and an exit, wherein said frame is composed at least partially of a perforated plate structure having round holes or hole cut-outs at least on side surfaces of said frame, further wherein said holes or hole cut-outs are provided over a significant portion of a height of said frame, further wherein said perforated plate frame is provided with two side plates and a base plate that are fixedly connected or welded together to form an essentially U-shaped structure, and wherein said base plate has a hole pattern that is symmetrical to a longitudinal centerline thereof.

16. An escalator or moving sidewalk according to claim 15, wherein said side plates and said base plate have the same hole pattern and are 15, wherein said side plates and said base plate have the same hole pattern and are prefabricated in a given length of from 2 to 6 m, preferably approximately 4 m, and wherein said base plate and said side plates are adapted to be joined together on site, in particular by welding.

17. An escalator or moving sidewalk, comprising:

a frame to form a supporting structure between an entry and an exit, wherein said frame is composed at least partially of a perforated plate structure having round holes or hole cut-outs at least on side surfaces of said frame, further wherein said holes or hole cut-outs are provided over a significant portion of a height of said frame, further wherein said perforated elate frame is provided with two side plates and a base plate that are fixedly connected or welded together to form an essentially U-shaped structure, and wherein ribs are secured, in particular via welding, to said base plate to reinforce said base plate against bending.

18. An escalator or moving sidewalk according to claim 17, wherein said side plates form an identical hole pattern and are in particular symmetrical to one another.

19. An escalator or moving sidewalk according to claim, comprising:

a frame to form a supporting structure between an entry and an exit, wherein said frame is composed at least partially of a perforated plate structure having round holes or hole cut-outs at least on side surfaces of said frame, further wherein said holes or hole cut-outs are provided over a significant portion of a height of said frame, and wherein a hole pattern is produced in said perforated plate frame via laser cutting.

* * * * *